US008914913B2

(12) United States Patent
Jones

(10) Patent No.: US 8,914,913 B2
(45) Date of Patent: Dec. 23, 2014

(54) PULL AWAY VEST WITH DETACHABLE SHOULDERS

(75) Inventor: Gregory C. Jones, Owingsville, KY (US)

(73) Assignee: Gregory C Jones, Owingsville, KY (US)

( * ) Notice: Subject to any disclaimer, the term of this patent is extended or adjusted under 35 U.S.C. 154(b) by 288 days.

(21) Appl. No.: 12/779,213

(22) Filed: May 13, 2010

(65) Prior Publication Data

US 2011/0277212 A1 Nov. 17, 2011

(51) Int. Cl.
*A41D 1/04* (2006.01)

(52) U.S. Cl.
USPC ..... 2/102; 2/243.1

(58) Field of Classification Search
USPC ..... 2/102, 113, 459, 461, 462, 94, 95, 126, 2/92
See application file for complete search history.

(56) References Cited

U.S. PATENT DOCUMENTS

| | | | | | |
|---|---|---|---|---|---|
| 2,620,479 | A | | 12/1952 | Buck | |
| 2,755,480 | A | | 7/1956 | Jones et al. | |
| 3,116,491 | A | * | 1/1964 | Previdi et al. | 2/106 |
| D203,250 | S | * | 12/1965 | O'Link | D2/829 |
| 3,452,362 | A | * | 7/1969 | Korolick et al. | 2/2.5 |
| 4,601,067 | A | * | 7/1986 | Buonassissi | 2/102 |
| 4,999,850 | A | | 3/1991 | Grilliot et al. | |
| 5,023,953 | A | * | 6/1991 | Bettcher | 2/126 |
| 5,331,683 | A | * | 7/1994 | Stone et al. | 2/2.5 |
| 5,398,340 | A | * | 3/1995 | Kibbee | 2/2.5 |
| 5,495,620 | A | * | 3/1996 | Schoenweiss et al. | 2/2.5 |
| 5,628,064 | A | * | 5/1997 | Chung | 2/70 |
| 5,774,892 | A | * | 7/1998 | Tisdale et al. | 2/69 |
| 5,815,833 | A | * | 10/1998 | Kuo | 2/69.5 |
| 6,138,277 | A | * | 10/2000 | Gillen et al. | 2/102 |
| 6,247,178 | B1 | * | 6/2001 | Bilda | 2/69 |
| 6,282,718 | B1 | * | 9/2001 | Drakford | 2/70 |
| 6,349,413 | B1 | * | 2/2002 | Rose et al. | 2/126 |
| 6,360,372 | B2 | * | 3/2002 | Oster | 2/126 |
| 6,408,440 | B1 | * | 6/2002 | Phillips | 2/102 |
| 6,691,318 | B1 | * | 2/2004 | Davis | 2/102 |
| 6,769,137 | B2 | | 8/2004 | D'Annunzio | |
| 6,948,188 | B2 | | 9/2005 | D'Annunzio | |

(Continued)

FOREIGN PATENT DOCUMENTS

| | | | |
|---|---|---|---|
| GB | 2418592 | A | 4/2006 |
| WO | WO 2009/051619 | A2 | 4/2009 |

OTHER PUBLICATIONS

International Search Report, Form PCT/ISA/210, 2 pages, for International Application No. PCT/US2011/000808 completed on Sep. 7, 2011 and mailed Sep. 15, 2011.

*Primary Examiner* — Khoa Huynh
*Assistant Examiner* — Andrew W Collins
(74) *Attorney, Agent, or Firm* — Francis Law Office PLLC; James M. Francis

(57) ABSTRACT

A vest is disclosed that the user can remove without removing an outer garment such as a coat. The vest utilizes hook and loop fasteners at the shoulder to allow the back and front to be separated. In order to facilitate separation, a pull cord is attached at the rear shoulder and crosses the back of the vest and passes through a guide near the opposing hip. When the pull cord is pulled the opposing shoulder that has been separated is peeled back and down across the back allowing the user to remove the vest without removing an overcoat.

17 Claims, 3 Drawing Sheets

(56) References Cited

U.S. PATENT DOCUMENTS

| | | | | |
|---|---|---|---|---|
| 7,243,376 | B2 * | 7/2007 | Johnson | 2/102 |
| 7,793,360 | B2 * | 9/2010 | Blauer et al. | 2/81 |
| 2002/0120973 | A1 | 9/2002 | D'Annunzio | |
| 2004/0139526 | A1 | 7/2004 | Davis | |
| 2005/0005342 | A1 * | 1/2005 | Johnson | 2/102 |
| 2007/0289045 | A1 * | 12/2007 | Evans et al. | 2/102 |
| 2008/0005825 | A1 | 1/2008 | Tronvold | |
| 2008/0216219 | A1 * | 9/2008 | Desnoyers | 2/463 |
| 2008/0252132 | A1 * | 10/2008 | Thomson | 297/465 |

* cited by examiner

PULL AWAY VEST WITH DETACHABLE SHOULDERS

BACKGROUND

1. Field of Technology

The present application relates to articles of clothing and more particularly to vests worn under clothing. Specifically, the present application relates to vests that can be removed without shedding an outer layer of clothing coving the vest.

2. Problems in the Art

Horseback riders in endurance events are required to ride for long periods of time through varying environmental conditions. The temperature may be cold enough to require the wearing of a vest under an outer article of clothing and then warm enough to require the rider remove the vest. Removal of the vest currently requires the rider stop riding, often dismount, and remove the outer articles of clothing covering the vest in order to remove the vest.

There exists a need for persons operating in varying conditions to remove an underlying vest or jacket while in motion or with the use of only one hand. Such conditions are not exclusive to endurance horseback riding and can include other sporting endeavors as well as law enforcement and military operations.

SUMMARY

The device of the present application is a vest that can be removed with one hand from underneath an outer layer of clothing, such as a coat. Pull cords are attached to at least one shoulder of the vest at the back and the cord crosses the back of the vest to a point near the opposing hip where is can be pulled. The pulling of the cord detaches the front and rear components of the shoulder to which it is connected and that is coupled by hook and loop fasteners. The cord also facilitates the removal of the vest when detached at the shoulder by using the back of the wearer as a pulley. The cord further facilitates the removal of the vest when detached at the shoulder by supplying enough force to cause the shoulder to detach and to pass beneath the outer layer of clothing by overcoming friction and the tendency for the hook and loop fastener to engage the fabric of the inside of the outer article of clothing.

An embodiment of the device includes detachable sleeves that are left behind when the vest is removed. The sleeves may then be pulled down the arm and over the hand of the wearer for removal. An embodiment utilizes hook and loop fasteners to secure the sleeves to the vest so as to allow them to decouple when the vest is pulled away.

One embodiment has the pull cord passing between an inner and outer layer of the vest.

Embodiments disclosed herein are not meant to be limiting, are solely intended to offer variations of a preferred embodiment, and are not meant to exclude equivalent variations or obvious derivations of the preferred embodiment that are not disclosed herein.

DETAILED DESCRIPTION OF THE DRAWINGS

Figure 1:
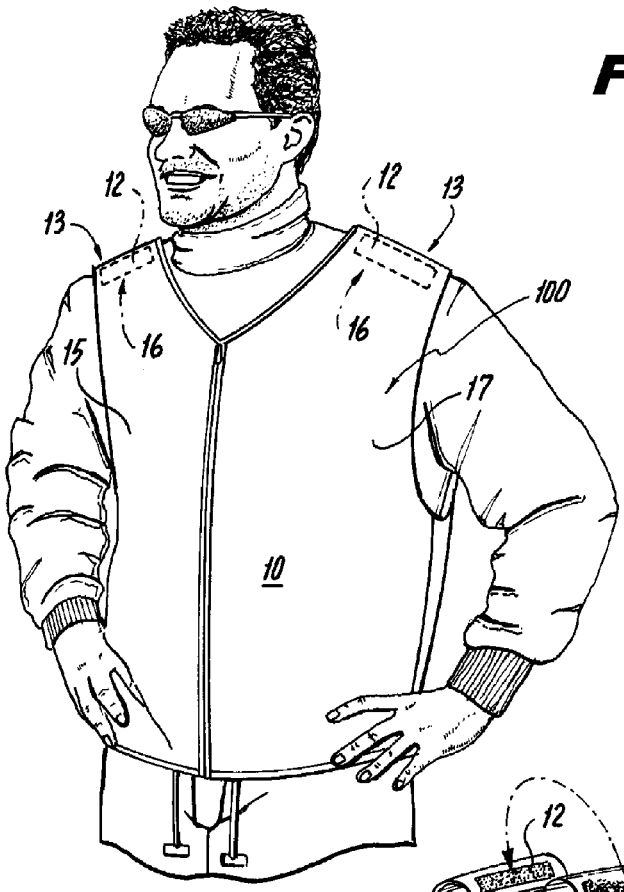
FIG. 1 is a perspective view of the front of the vest with a shoulder decoupled and the remaining should coupled by hook and loop fasteners.
Figure 2:
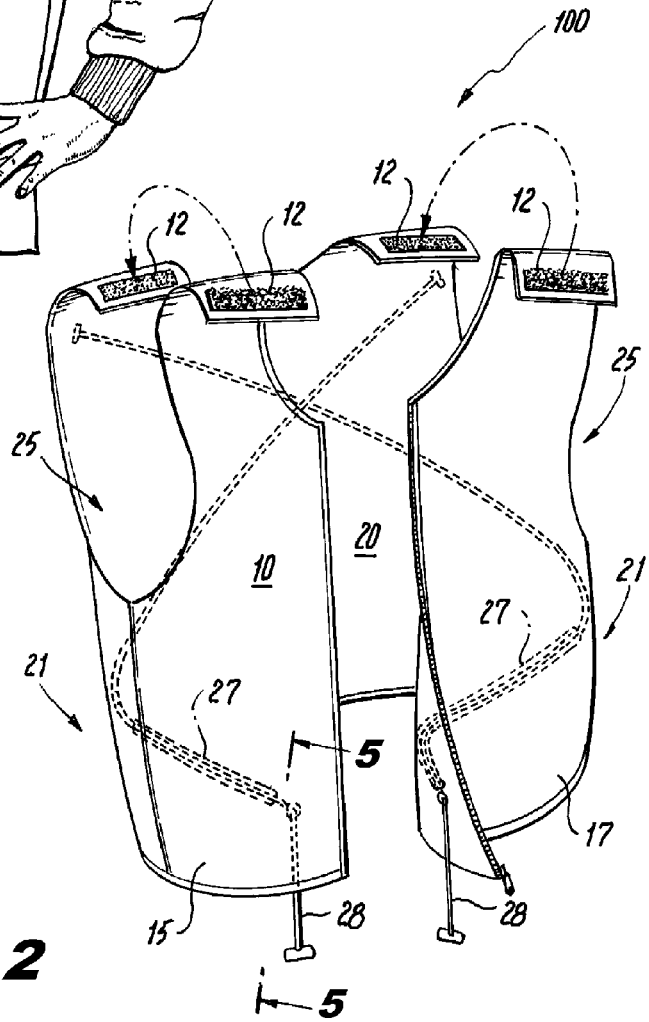
FIG. 2 is a perspective view of the back of the vest with a partial cutout depicting the pull cord as it wraps around the back.
Figure 3:
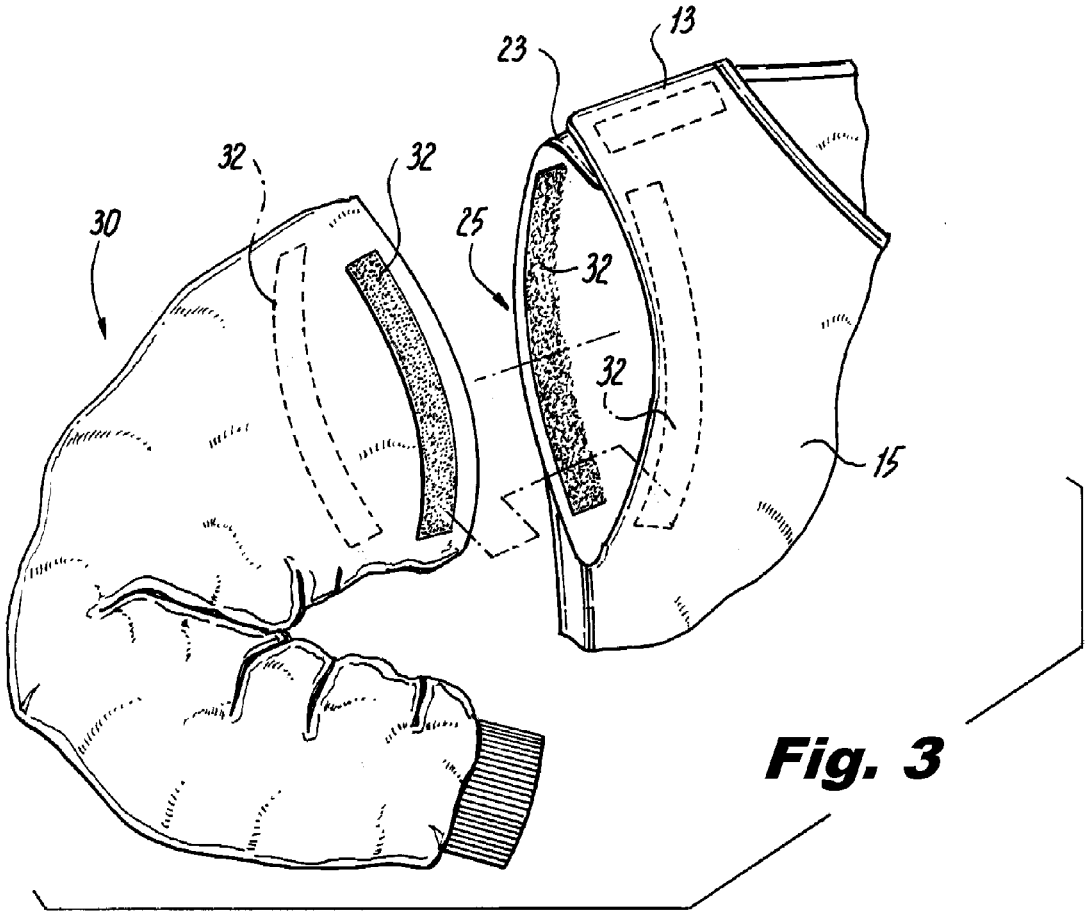
FIG. 3 depicts the vest with detachable sleeves.
Figure 4:
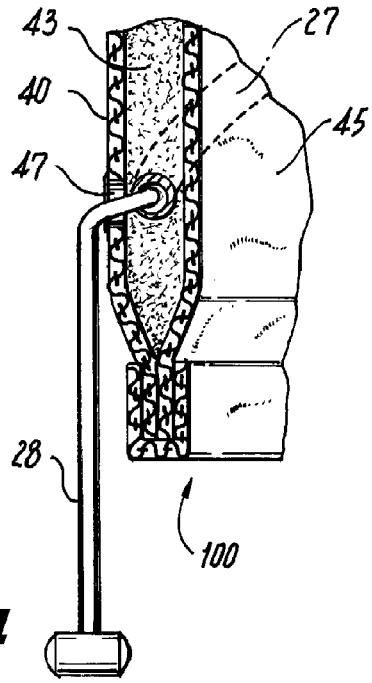
FIGS. 4 and 5 depicts the pull cord running between the inner layer and the outer layer of the right and left rear panels of the vest and through a pull cord exit.
Figure 5:
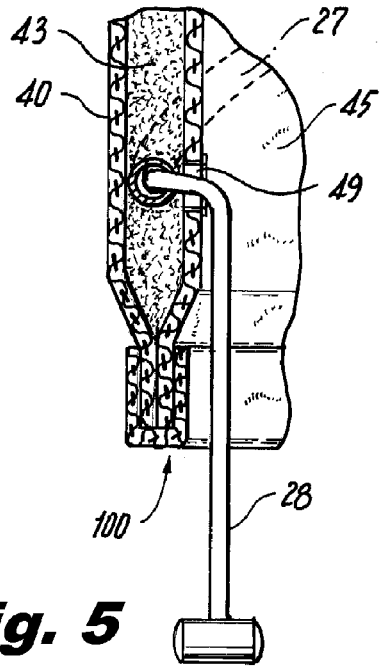
Figure 6:
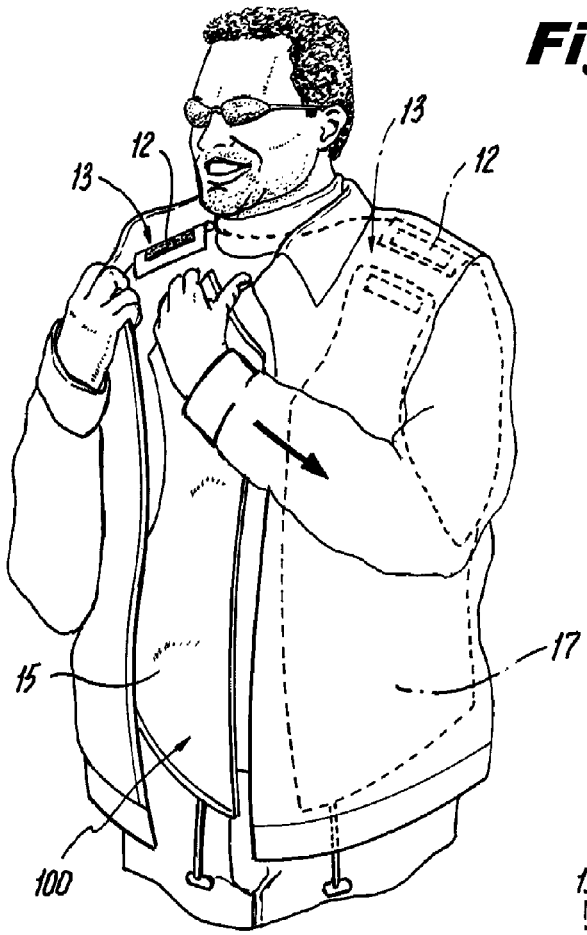
FIGS. 6 and 7 depict the method of removing the vest from underneath an overcoat.
Figure 7:
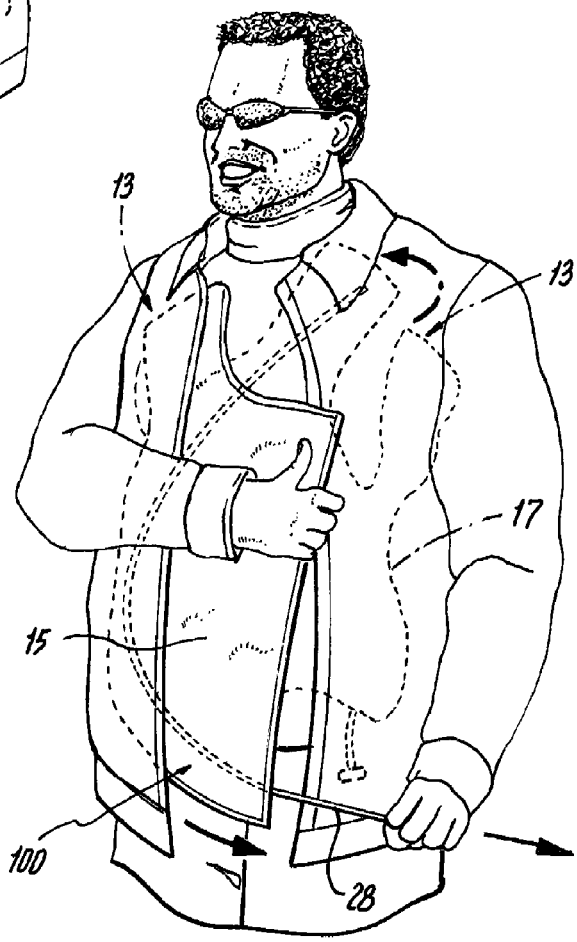

The device depicted in FIG. 1 depicts a vest 100 with hook and loop fabric 12 affixed at each front shoulder flap 13. Fasteners 16, such as hook and loop fabric, are utilized to couple the left vest front 17 and the right vest front 15 which are substantially bisected down the vest front 10.

The vest 100 has a vest front 10, from the perspective of the wearer, that is substantially bifurcated into a right vest front panel 15 and a left vest front panel 17. The shoulders 13 of the vest 100 incorporate front hook and loop fastener fabric pads 12. In an embodiment, the right vest front panel 15 and the left vest front panel 17 may be joined by fasteners 16.

The vest 100 has a vest rear 20 or rear panel 20, from the perspective of the wearer. The vest front 10 and the vest rear 20 are joined beneath the arm holes 25 of the vest 100. A pull cord 28 is attached to the rear shoulder flap 23. The pull cord 28 runs across the vest rear 20 and down toward the bottom hip 21 opposite the rear shoulder flap 23 where the pull cord 28 is attached, passing through at least one cord guide 27, which is utilized to guide the pull cord 28 when it is being pulled.

In an embodiment, sleeves 30 are attachable below the front shoulder flap 13 and rear shoulder flap 23 via sleeve fasteners 32. An embodiment utilizes hook and loop fabric as sleeve fasteners 32. Additional embodiments utilizes snaps, buttons or similar fasteners as sleeve fasteners 32.

An embodiment of the vest 100 utilizes an inner vest layer 45 and an outer vest layer 40. Further embodiments incorporate insulation 43 placed between the inner vest layer 45 and the outer vest layer. The insulation 43 could be additional layers of material, feathers, fiberglass, or similar insulating materials used in clothing.

Embodiments of the vest 100 place the pull cord 28 running outside the outer vest layer 40 for potential replacement or reattachment of the pull cord 28, inside the inner vest layer 45, and between the inner vest layer 45 and the outer vest layer 40. Embodiments where the pull cord runs between the inner vest layer 45 and the outer vest layer 40 can utilize an outer pull cord exit 47 where the pull cord 28 passes through the outer vest layer 40 where it can be accessed from outside the vest 100. Alternatively, the pull cord 28 can pass through the inner vest layer 45 through an inner pull cord exit 49 where it can be accessed from inside the vest 100.

What is claimed is:

1. An article of clothing comprising:

a vest, wherein said vest has a vest front and a vest back, wherein said vest front and said vest back are joined by at least one side joint, a right shoulder joint, and a left shoulder joint and further comprising arm holes when said vest back and said vest front are joined together;

said right and left shoulder joints being detachably coupled; and at least one cord securely affixed to said vest back to at least one said shoulder joint on said vest back, wherein said at least one cord passes diagonally down across said vest back from the point where said cord is attached at said shoulder joint, passing from vest back to said vest front beneath the opposing said arm hole so as to wrap around the back and torso of a wearer of said vest, through a cord guide and a cord guide exit so as to permit said cord to pull said vest rear away from said vest front at said shoulder joint when said cord is pulled through said cord guide exit.

2. The article of clothing of claim 1, wherein said right and left shoulder joints are detachably coupled by hook and loop fastener fabric.

3. The article of clothing of claim 2, wherein said vest back possesses an inner wall and an outer wall and said cord passes between said inner and outer wall and through said cord guide to exit through said outer wall at said cord guide exit.

4. The article of clothing of claim 3, wherein said cord guide is a channel created by joining said inner wall and said outer wall together so as to border and retain said cord.

5. The article of clothing of claim 1, wherein said vest is detachably coupled along at least one side joint.

6. The article of clothing of claim 1, wherein said vest front is substantially vertically bisected and coupled by a fastening means.

7. The article of clothing of claim 6, wherein said fastening means is selected from the group consisting of buttons and corresponding button holes, a zipper, hook and loop fasteners, hook and loop fastener fabric, and snap fasteners.

8. The article of clothing of claim 1, wherein sleeves may be removably attached to said vest.

9. The article of clothing of claim 1, further comprising two cords, two cord guides and two cord guide exits, one said cord affixed to each shoulder and each said cord running down and across said vest back and passing through a cord guide and a cord guide exit so as to permit said cord to transit through said cord guide and said cord guide exit when pulled.

10. The article of clothing of claim 1, wherein said cord guide is at least one loop through which said cord passes.

11. An article of clothing comprising:

a vest, wherein said vest has a vest front and a vest back, wherein said vest front and said vest back are joined by at least one side joint, a right shoulder joint and a left shoulder joint and further comprising arm holes when said vest back and said vest front are joined together, wherein said right and left should joints are detachably coupled by hook and loop fastener fabric;

at least one cord securely affixed to at least one said shoulder joint on said vest back, wherein said at least one cord passes diagonally down across said vest back from the point where said cord is attached at said shoulder joint, passing from vest back to said vest front beneath the opposing said arm hole so as to wrap around the back and torso of a wearer of said vest, through a cord guide and a cord guide exit so as to permit said cord to pull said vest rear away from said vest front at said shoulder joint when said cord is pulled through said cord guide exit; and said vest back possesses an inner wall and an outer wall and said cord passes between said inner and outer wall and through said cord guide to exit through said outer wall at said cord guide exit.

12. The article of clothing of claim 11, wherein said cord guide is a channel created by joining said inner wall and said outer wall together so as to border and retain said cord.

13. The article of clothing of claim 12, wherein said vest is detachably coupled along at least one side joint.

14. The article of clothing of claim 11, wherein said vest front is substantially vertically bisected and coupled by a fastening means.

15. The article of clothing of claim 14, wherein said fastening means is selected from the group consisting of buttons and corresponding button holes, a zipper, hook and loop fasteners, hook and loop fastener fabric, and snap fasteners.

16. The article of clothing of claim 11, further comprising two cords, two cord guides and two cord guide exits one affixed to each shoulder and each said cord running down and across said vest back and passing through a cord guide and a cord guide exit so as to permit said cord to transit through said cord guide and said cord guide exit when pulled.

17. The article of clothing of claim 11, further comprising removably attached sleeves to said vest.

* * * * *